US008393107B2

(12) United States Patent
Brown

(10) Patent No.: US 8,393,107 B2
(45) Date of Patent: Mar. 12, 2013

(54) FIREARM ASSEMBLY INCLUDING A FIRST WEAPON AND A SECOND WEAPON SELECTIVELY MOUNTED TO THE FIRST WEAPON

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 543 days.

(21) Appl. No.: 12/548,025

(22) Filed: Aug. 26, 2009

(65) Prior Publication Data

US 2012/0151813 A1 Jun. 21, 2012

Related U.S. Application Data

(60) Provisional application No. 61/190,089, filed on Aug. 26, 2008.

(51) Int. Cl.
*F41C 27/06* (2006.01)

(52) U.S. Cl. ..... 42/105; 89/1.41

(58) Field of Classification Search ..... 42/72, 85, 42/105, 106, 90; 89/1.41
See application file for complete search history.

(56) References Cited

U.S. PATENT DOCUMENTS

| | | | | |
|---|---|---|---|---|
| 1,379,989 | A | | 5/1921 | Johnson |
| 1,402,459 | A | | 1/1922 | Swebilius |
| 1,846,993 | A | | 2/1932 | Destree |
| 1,878,038 | A | | 9/1932 | Von Frommer |
| 2,341,767 | A | | 2/1944 | Gans |
| 2,462,119 | A | | 2/1949 | Moore |
| 2,685,754 | A | | 8/1954 | Crittendon et al. |
| 2,752,826 | A | | 7/1956 | Simpson |
| 2,775,166 | A | | 12/1956 | Janson |
| 2,780,145 | A | | 2/1957 | Saive |
| 2,783,685 | A | | 3/1957 | Green |
| 2,882,635 | A | | 4/1959 | Hill |
| 2,951,424 | A | | 9/1960 | Stoner |
| 3,176,424 | A | | 4/1965 | Hoge |
| 3,198,076 | A | | 8/1965 | Stoner |
| 3,236,155 | A | | 2/1966 | Sturtevant |
| 3,255,667 | A | | 6/1966 | Walther |
| 3,300,889 | A | | 1/1967 | Baker |
| 3,368,298 | A | | 2/1968 | Browning |
| 3,397,473 | A | | 8/1968 | Browning |
| 3,405,470 | A | | 10/1968 | Wesemann |
| 3,507,067 | A | * | 4/1970 | Into ..... 42/10 |
| 3,592,101 | A | | 7/1971 | Vartanian et al. |

(Continued)

OTHER PUBLICATIONS

U.S. Appl. No. 12/496,000, filed Jul. 1, 2009, entitled "Firearm Having an Indirect Gas Impingement System" (61 pages).

(Continued)

*Primary Examiner* — Benjamin P Lee
(74) *Attorney, Agent, or Firm* — Howard & Howard Attorneys PLLC

(57) ABSTRACT

A firearm assembly including a first weapon having a first receiver is disclosed. The first receiver includes a front end with a barrel attached to the front end and a front sight attached to the barrel. A second weapon is selectively mounted to the first weapon and movable between an engaged and disengaged position. The second weapon includes a second receiver and a mounting system having a first portion attached to the second receiver and a second portion coupled to the second receiver. The first portion is coupled to the front sight to define a first attachment point when the second weapon is in the engaged position. The second portion includes a first end coupled to the front sight to define a second attachment point and a second end coupled to the first receiver to define a third attachment point when the second weapon is in the engaged position.

33 Claims, 11 Drawing Sheets

U.S. PATENT DOCUMENTS

| | | | | |
|---|---|---|---|---|
| 3,618,457 | A | 11/1971 | Miller | |
| 3,619,926 | A | 11/1971 | Alday | |
| 3,675,534 | A | 7/1972 | Beretta | |
| 3,686,998 | A | 8/1972 | Seifried | |
| 3,742,636 | A | 7/1973 | Dealy et al. | |
| 3,771,415 | A | 11/1973 | Into et al. | |
| 3,774,498 | A | 11/1973 | Moller et al. | |
| 3,776,095 | A | 12/1973 | Atchisson | |
| 3,938,271 | A | 2/1976 | Hyytinen | |
| 3,938,422 | A | 2/1976 | Tellie | |
| 3,960,053 | A | 6/1976 | Conley | |
| 3,969,980 | A | 7/1976 | Brandstatter et al. | |
| 3,999,461 | A | 12/1976 | Johnson et al. | |
| 4,020,741 | A | 5/1977 | Junker | |
| 4,044,487 | A | 8/1977 | Hutton et al. | |
| 4,088,057 | A | 5/1978 | Nasypany | |
| 4,125,054 | A | 11/1978 | Jennie | |
| 4,244,273 | A | 1/1981 | Langendorfer, Jr. et al. | |
| 4,246,830 | A | 1/1981 | Krieger | |
| 4,358,986 | A | 11/1982 | Giorgio | |
| 4,389,920 | A | 6/1983 | Dufour, Sr. | |
| 4,398,448 | A | 8/1983 | LaFever | |
| 4,505,182 | A | 3/1985 | Sullivan | |
| 4,553,469 | A | 11/1985 | Atchisson | |
| 4,654,993 | A | 4/1987 | Atchisson | |
| 4,663,875 | A | 5/1987 | Tatro | |
| 4,689,911 | A | 9/1987 | White | |
| 4,693,170 | A | 9/1987 | Atchisson | |
| 4,703,826 | A | 11/1987 | Byron | |
| 4,733,489 | A * | 3/1988 | Kurak | 42/77 |
| 4,756,228 | A | 7/1988 | Roth | |
| 4,765,224 | A | 8/1988 | Morris | |
| 4,766,800 | A | 8/1988 | Miller et al. | |
| 4,867,039 | A | 9/1989 | Dobbins | |
| 4,893,547 | A | 1/1990 | Atchisson | |
| 4,972,617 | A | 11/1990 | Major | |
| 5,198,600 | A | 3/1993 | E'Nama | |
| 5,343,650 | A | 9/1994 | Swan | |
| 5,351,598 | A | 10/1994 | Schuetz | |
| 5,540,008 | A | 7/1996 | Kirnstatter | |
| 5,628,137 | A * | 5/1997 | Cortese | 42/105 |
| 5,821,445 | A | 10/1998 | Guhring | |
| 5,824,923 | A | 10/1998 | Kondoh et al. | |
| 5,827,992 | A | 10/1998 | Harris et al. | |
| 5,918,401 | A | 7/1999 | Rowlands | |
| 5,930,935 | A * | 8/1999 | Griffin | 42/105 |
| 5,945,626 | A | 8/1999 | Robbins | |
| 6,019,024 | A | 2/2000 | Robinson et al. | |
| 6,134,823 | A | 10/2000 | Griffin | |
| 6,250,194 | B1 | 6/2001 | Brandl et al. | |
| 6,311,603 | B1 | 11/2001 | Dunlap | |
| 6,418,655 | B1 | 7/2002 | Kay | |
| 6,453,594 | B1 | 9/2002 | Griffin | |
| 6,481,145 | B2 | 11/2002 | Weichert et al. | |
| 6,499,246 | B1 | 12/2002 | Zedrosser | |
| 6,532,947 | B1 * | 3/2003 | Rosa et al. | 124/56 |
| 6,564,491 | B2 | 5/2003 | Murello | |
| 6,594,937 | B2 * | 7/2003 | Weichert et al. | 42/105 |
| 6,609,321 | B2 | 8/2003 | Faifer | |
| 6,619,592 | B2 | 9/2003 | Vignaroli et al. | |
| 6,625,916 | B1 | 9/2003 | Dionne | |
| 6,634,274 | B1 | 10/2003 | Herring | |
| 6,722,255 | B2 | 4/2004 | Herring | |
| 6,732,466 | B2 | 5/2004 | Bentley | |
| 6,752,137 | B2 * | 6/2004 | Brunette et al. | 124/74 |
| 6,782,791 | B2 | 8/2004 | Moore | |
| 6,829,858 | B2 | 12/2004 | Gablowski | |
| 6,848,351 | B1 | 2/2005 | Davies | |
| 7,000,345 | B1 | 2/2006 | Kay | |
| D517,637 | S * | 3/2006 | Murello et al. | D22/103 |
| 7,010,879 | B2 | 3/2006 | Olson | |
| 7,131,228 | B2 | 11/2006 | Hochstrate et al. | |
| RE39,465 | E | 1/2007 | Swan | |
| 7,231,861 | B1 | 6/2007 | Gauny et al. | |
| 7,337,574 | B2 * | 3/2008 | Crandall et al. | 42/75.03 |
| 7,418,898 | B1 | 9/2008 | Desomma | |
| 7,448,307 | B1 | 11/2008 | Dafinov | |
| 7,461,581 | B2 | 12/2008 | Leitner-Wise | |
| 7,469,624 | B1 | 12/2008 | Adams | |
| 7,478,495 | B1 | 1/2009 | Alzamora et al. | |
| 7,634,959 | B2 * | 12/2009 | Frickey | 89/136 |
| 7,661,220 | B2 * | 2/2010 | Crandall et al. | 42/70.06 |
| D633,977 | S * | 3/2011 | Murello et al. | D22/103 |
| 2001/0042334 | A1 * | 11/2001 | Weichert et al. | 42/105 |
| 2003/0074822 | A1 | 4/2003 | Faifer | |
| 2005/0115134 | A1 | 6/2005 | Bond et al. | |
| 2005/0115398 | A1 | 6/2005 | Olson | |
| 2005/0262752 | A1 | 12/2005 | Robinson et al. | |
| 2006/0065112 | A1 | 3/2006 | Kuczynko et al. | |
| 2006/0156606 | A1 | 7/2006 | Robinson et al. | |
| 2006/0236582 | A1 | 10/2006 | Lewis et al. | |
| 2006/0254112 | A1 | 11/2006 | Snoderly | |
| 2007/0033851 | A1 | 2/2007 | Hochstrate et al. | |
| 2007/0199435 | A1 | 8/2007 | Hochstrate et al. | |
| 2008/0110074 | A1 | 5/2008 | Bucholtz et al. | |
| 2009/0000173 | A1 | 1/2009 | Robinson et al. | |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2011/0225865 | A1 * | 9/2011 | Williams | 42/90 |

OTHER PUBLICATIONS

U.S. Appl. No. 12/496,008, filed Jul. 1, 2009, entitled "Firearm Having a Handle Assembly for Charging and Forward Assist" (50 pages).

U.S. Appl. No. 12/496,030, filed Jul. 1, 2009, entitled "Firearm Having a Debris Shield" (43 pages).

U.S. Appl. No. 12/495,996, filed Jul. 1, 2009, entitled "Firearm Having an Expulsion Device" (38 pages).

U.S. Appl. No. 12/496,003, filed Jul. 1, 2009, entitled "Firearm Including Improved Hand Guard" (48 pages).

U.S. Appl. No. 12/496,011, filed Jul. 1, 2009, entitled "Firearm Having a Debris Shield for Use With a Direct Gas Impingement System" (25 pages).

Article entitled "The USA's M4 Carbine Controversy" dated Feb. 2, 2009; www.defenseindustrydaily.com/the-usas-m4-carbine-controversy-03289/.

Article entitled "M4 Carbine Review" dated May 2, 2007; http://home.comcast.net/ shooter2_indy/m4.html.

Article entitled "Critics Turn Crosshairs on Military's Main Rifle" dated Apr. 20, 2008 from the website "USA TODAY"; www.usatoday.com/news/military/2008-04-20-gunwars_N.htm.

Parts Schematic entitled "Schematic for Bushmaster M4A3 Carbine" from the website "Bushmaster" dated Jun. 2008; www.bushmaster.com/electronic-documents/operation-manual/opmanual.pdf.

Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.

Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.

Article entitled "M26 Modular Accessory Shotgun System" from Wikipedia, the free encyclopdia dated Jun. 2008; http://en.wikipedia.org/wiki/M26_Modular_Accessory_Shotgun_System.

Article entitled "M16 rifle" from Wikipedia, the free encyclopedia dated Jun. 2008; http://en.wikipedia.org/wiki/M-16_rifle.

Article entitled "M4 Carbine" from Wikipedia, the free encyclopedia dated Jun. 2008; http://en.wikipedia.org/wiki/M4_carbine.

Animation entitled "How an AR15 Works" from the website dated Jun. 2008; www.barnesengineering.com/AR15animation/index.htm.

* cited by examiner

FIREARM ASSEMBLY INCLUDING A FIRST WEAPON AND A SECOND WEAPON SELECTIVELY MOUNTED TO THE FIRST WEAPON

CROSS REFERENCE TO RELATED APPLICATION

The subject patent application claims priority to and the benefit of U.S. Provisional Patent Application No. 61/190,089, filed on Aug. 26, 2008.

BACKGROUND OF THE INVENTION

1. Field of the Invention

The subject invention relates to firearm assemblies and more specifically to selectively mounting a pair of firearms together.

2. Description of the Prior Art

Firearms, such as rifles and shotguns, typically include a receiver that houses several working components of the firearm, including firing components, with a barrel extending from the receiver. A magazine is typically coupled to the receiver and stores ammunition therein. Some firearms include tactical attachments which are detachably mounted to the firearm. For example, tactical attachments can include a flashlight, a grenade launcher or a shotgun, such as the M26 Modular Accessory Shotgun System (MASS) manufactured by Vertu Corporation.

In this system, a shotgun detachably mounts to a rifle such that the rifle and the shotgun can be used as a single unit when attached to each other or as stand-alone weapons when detached from each other. However, the shotgun when mounted to the rifle fails to include a hand grip. Accordingly, when firing the shotgun as the single unit, a user must grasp the magazine of the rifle. This can stress the magazine of the rifle.

The shotgun does include a buttstock which is attachable when using the shotgun as the stand-alone. The buttstock is detachable when using the rifle and the shotgun as the single unit. The buttstock includes individual small components to mount the buttstock to the receiver for using the shotgun as the stand-alone. In addition, the separate buttstock of the shotgun includes a hand grip thus causing the buttstock to be bulky when carrying the buttstock in a pack.

Therefore, there remains a need to provide a firearm assembly having a mounting system that allows a second weapon to be easily mounted to and/or detached from a first weapon while eliminating small components to assemble the second weapon as a stand-alone.

SUMMARY OF THE INVENTION AND ADVANTAGES

The present invention provides for a firearm assembly including a first weapon having a first receiver. The first receiver includes a front end with a barrel attached to the front end and a front sight attached to the barrel. The firearm assembly further includes a second weapon selectively mounted to the first weapon with the second weapon including a second receiver. A mounting system is coupled to the second receiver with the second weapon being movable between an engaged position attached to the first weapon and a disengaged position detached from the first weapon. The mounting system includes a first attachment segment attached to the second receiver and coupled to the front sight when the second weapon is in the engaged position. The mounting system further includes a second attachment segment coupled to the second receiver and spaced from the first attachment segment with the second attachment segment coupled to the front sight when the second weapon is in the engaged position. The mounting system also includes a third attachment segment coupled to the second receiver and spaced from the first and second attachment segments with the third attachment segment coupled to the first receiver when the second weapon is in the engaged position.

The present invention further provides for the firearm assembly including the first weapon having the first receiver. The first receiver includes the front end with the barrel attached to the front end and the front sight attached to the barrel. The firearm assembly further includes the second weapon selectively mounted to the first weapon with the second weapon including the second receiver and the mounting system coupled to the second receiver. The second weapon is movable between the engaged position attached to the first weapon and the disengaged position detached from the first weapon. The mounting system includes a first portion attached to the second receiver and coupled to the front sight to define a first attachment point when the second weapon is in the engaged position. The mounting system further includes a second portion coupled to the second receiver and spaced from the first portion with the second portion having a first end coupled to the front sight to define a second attachment point and a second end coupled to the first receiver to define a third attachment point when the second weapon is in the engaged position.

The present invention also provides for the firearm assembly including the first weapon and the second weapon selectively mounted to the first weapon. The second weapon is movable between the engaged position attached to the first weapon and the disengaged position detached from the first weapon. The second weapon includes a receiver, a buttstock and the mounting system coupled to the receiver. A portion of the mounting system is rotatable about a pivot axis when the second weapon is in the disengaged position. The portion is rotatable between a first position presenting a plurality of attachment segments to the first weapon for allowing the second weapon to be mounted to the first weapon and a second position presenting at least one of the attachment segments to the buttstock for allowing the buttstock to be mounted to the portion.

Therefore, the present invention provides for a firearm assembly having a mounting system that allows a second weapon to be easily mounted to and/or detached from a first weapon without redesigning the first weapon. Further, the mounting system eliminates the need for individual small components when assembling the second weapon as a stand-alone as discussed for the prior art design.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
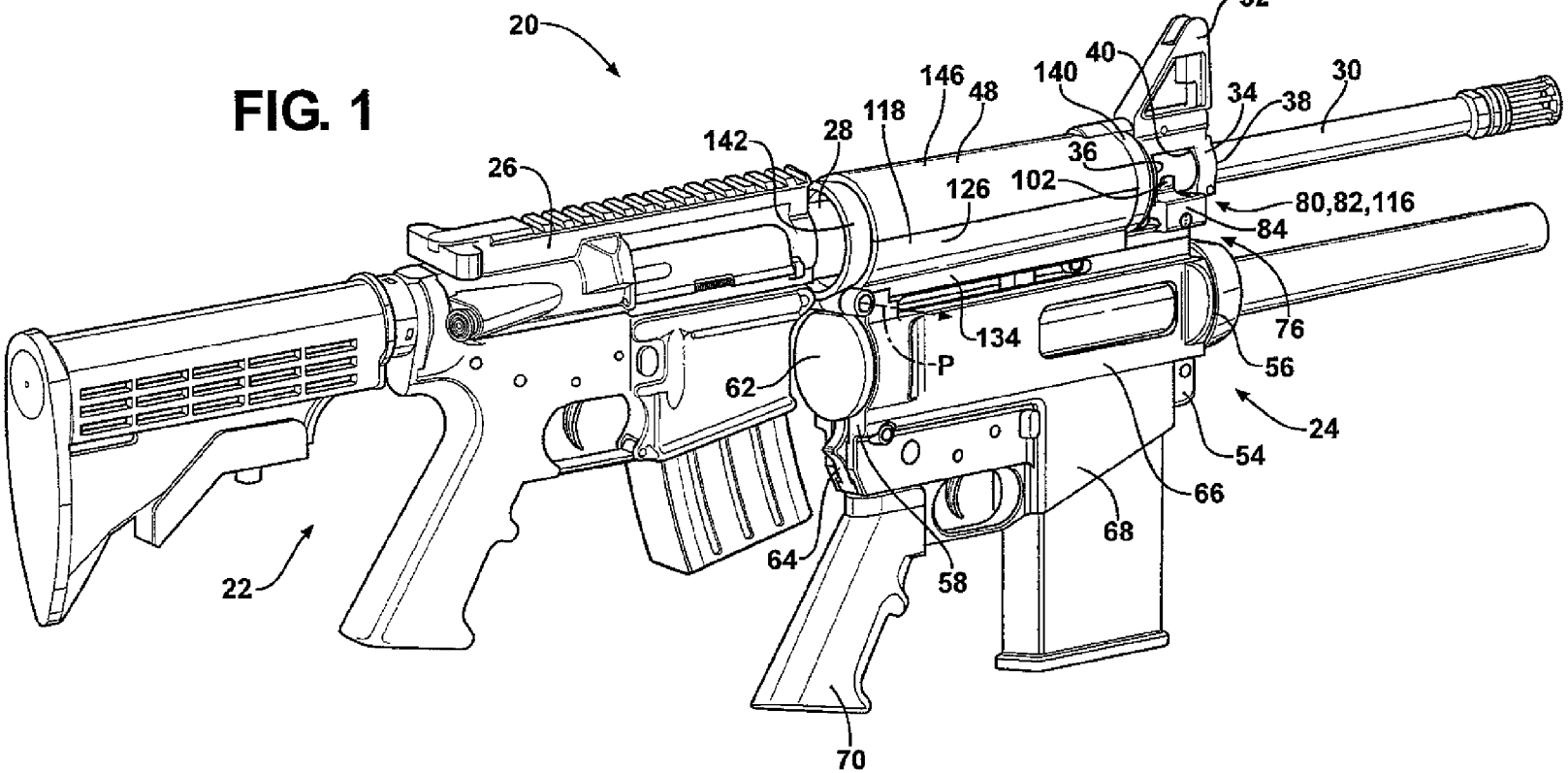
FIG. 1 is a perspective view of the firearm assembly illustrating a first weapon and a second weapon mounted to the first weapon in an engaged position with a second portion of a mounting system in a first position.
Figure 2:
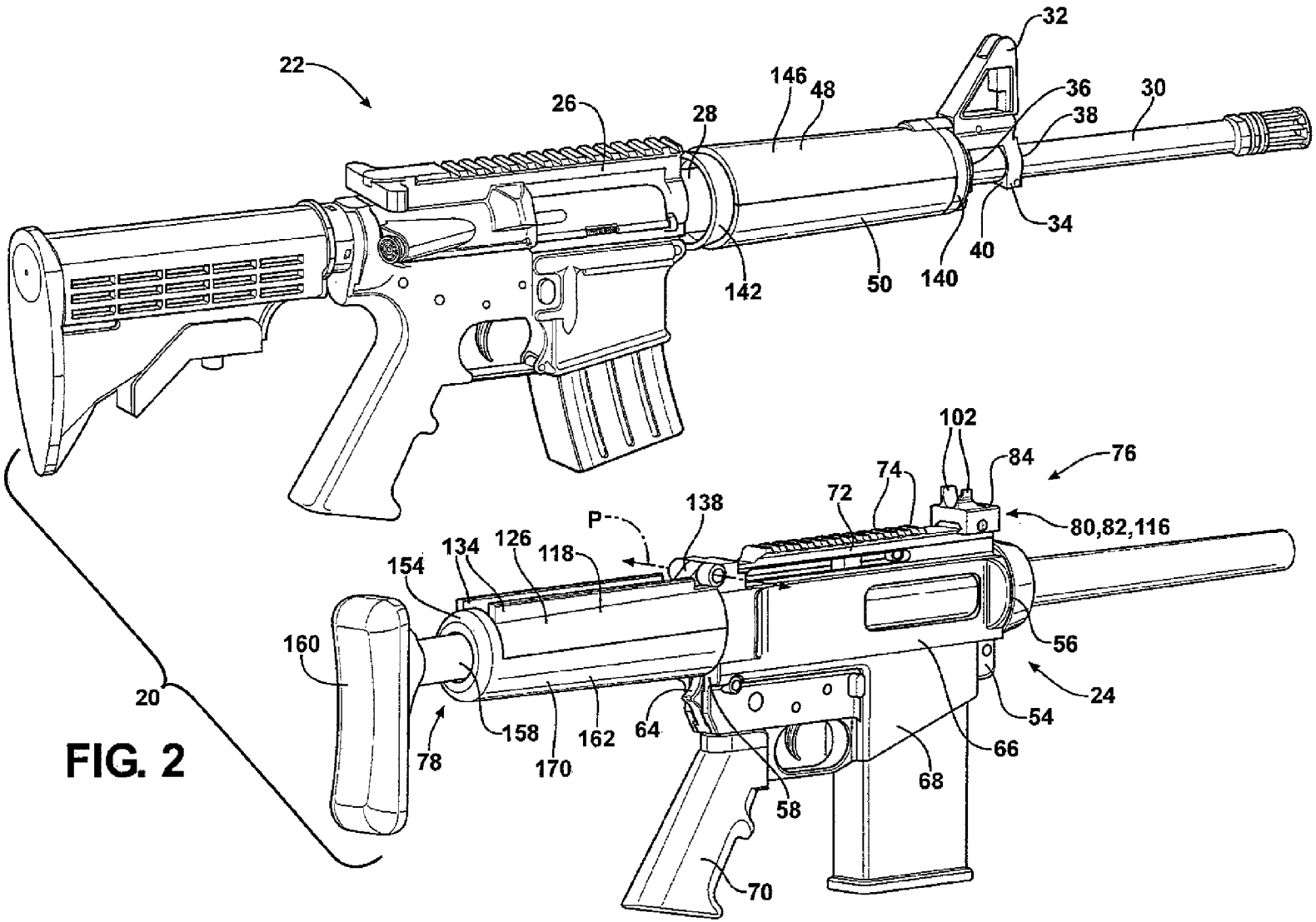
FIG. 2 is a perspective view of the first weapon and the second weapon converted to stand-alone weapons with the second portion in a second position.

Referring to the Figures, wherein like numerals indicate like or corresponding parts throughout the several views, a firearm assembly 20 is generally shown in FIGS. 1 and 2. The firearm assembly 20 includes a first weapon 22 and a second weapon 24 selectively mounted to the first weapon 22. Each of the first and second weapons 22, 24 receive and fire a live round of ammunition (not shown) as known to those skilled in the art. Each of the first and second weapons 22, 24 fire ammunition appropriate for that specific weapon.

The first weapon 22 can be of a certain class of weapon that utilizes a direct gas impingement system or an indirect gas impingement system to eject a spent round of ammunition after firing the first weapon 22. Preferably, the first weapon 22 is further defined as a rifle. Examples of such types of first weapons 22 include the M16, the M4®, such as the M4® carbine, and the AR-15® such as the AR-15® Platform. However, it should be appreciated that the first weapon 22 can be of any other type without departing from the nature of the present invention. The indirect gas impingement system utilizes a piston assembly (not shown) for moving a bolt carrier (not shown), as further disclosed and claimed in U.S. patent application Ser. No. 12/496,000 which is incorporated herein by reference. The direct gas impingement system routes exhaust gases from the barrel back to the bolt carrier and out an ejection port (not numbered), as further disclosed and claimed in U.S. patent application Ser. No. 12/496,011 which is incorporated herein by reference.

The second weapon 24 can be of a certain class of weapon that are semi-automatic, automatic, pump action, bolt action or lever action to eject a spent round of ammunition after firing the second weapon 24. Preferably, the second weapon 24 is further defined as a shotgun. Examples of such types of second weapons 24 include the M26. However, it should be appreciated that the second weapon 24 can be of any other type without departing from the nature of the present invention. The second weapon 24 described herein is designed to permit easy retro-fitting of the components to a variety of currently and/or previously manufactured first weapon 22 designs. Additional details of the first and second weapons 22, 24 are discussed below.

As best shown in FIGS. 1 and 2, the first weapon 22 includes a first receiver 26 having a front end 28 with a barrel 30 attached to the front end 28. The first receiver 26 houses several of the working components of the first weapon 22, such as the firing components, i.e. the action. As known in the art, the first receiver 26 is often divided into an upper receiver portion (not numbered) and a lower receiver portion (not numbered) attached to each other.

Figure 3A:
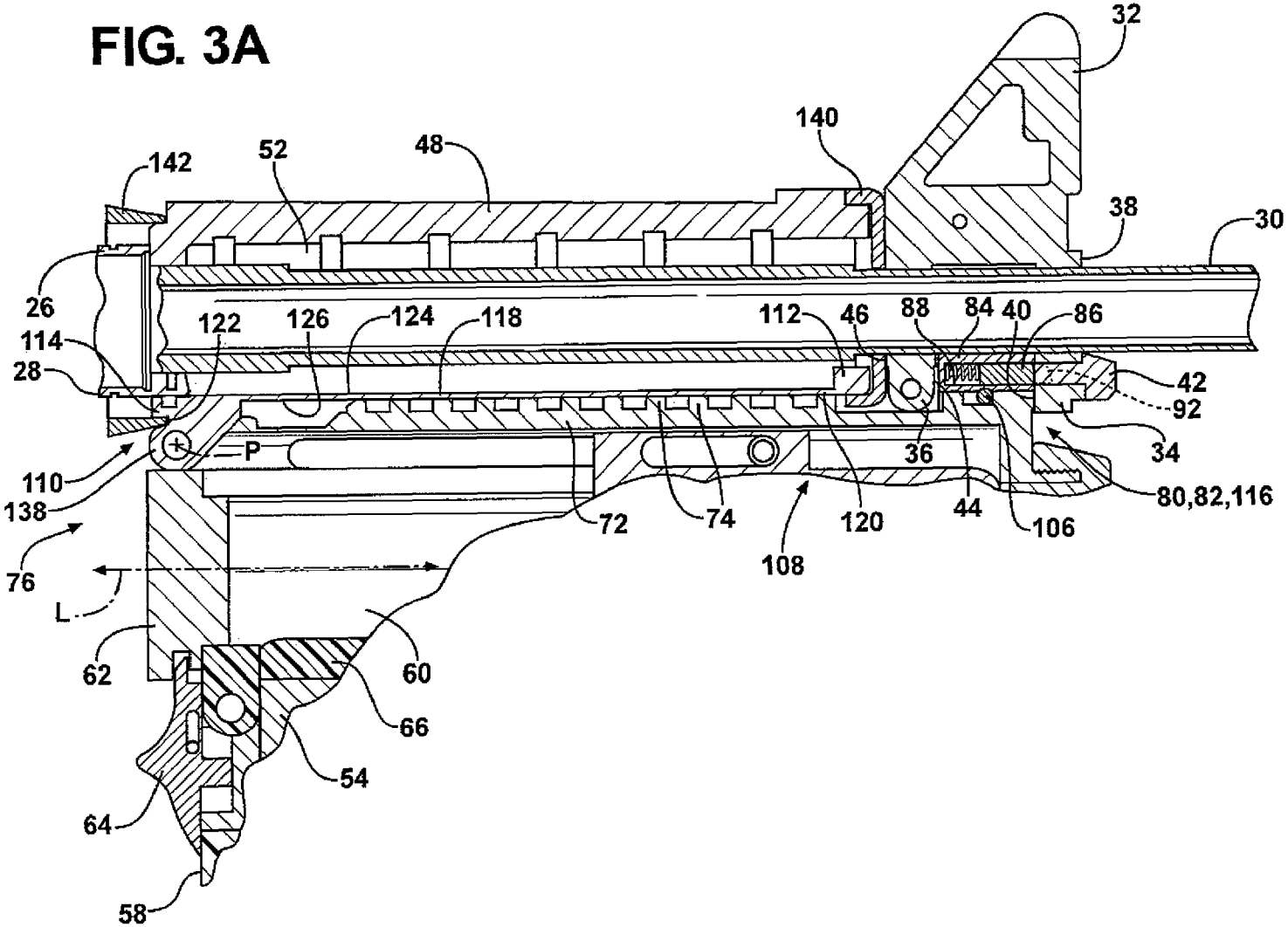
FIG. 3A is a broken partial cross-sectional view of the second weapon mounted to the first weapon in the engaged position with the second portion in the first position, a second support in a rest position, a locking device having a latch in a locked position and a locking member in an initial position.
Figure 3B:
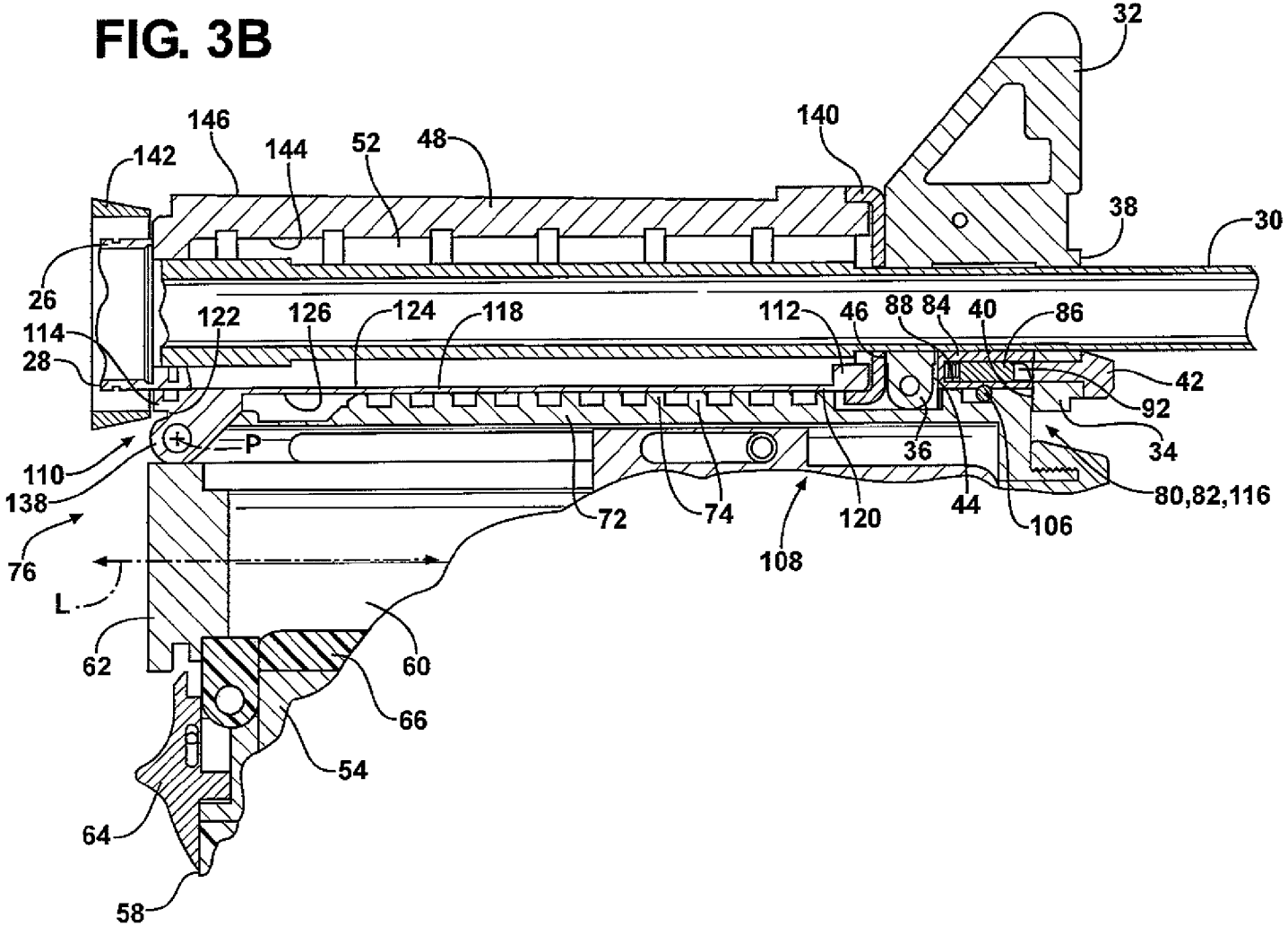
FIG. 3B is a broken partial cross-sectional view of the second weapon mounted to the first weapon in the engaged position with the second portion in the first position, the second support in a release position, the latch in an unlocked position and the locking member in a displaced position.

Also referring to FIGS. 3A and 3B, a front sight 32 is attached to the barrel 30 of the first weapon 22. More specifically, the front sight 32 includes a first leg 34 and a second leg 36 spaced from each other with each of the legs 34, 36 attached to the barrel 30. The first leg 34 includes a first front side 38 and a first back side 40 spaced from each other with a bayonet attachment 42 extending from the first front side 38. The second leg 36 includes a second front side 44 and a second back side 46 spaced from each other with the first back side 40 and the second front side 44 facing each other.

Referring back to FIGS. 1 and 2, the first weapon 22 further includes a hand guard portion 48 coupled to the first receiver 26 and the front sight 32. The hand guard portion is further defined as a first hand guard portion 48 and will be referred to as the first hand guard portion 48 throughout this description. The first weapon 22 also includes a second hand guard portion 50 engaging the first hand guard portion 48 to define a bore 52 therebetween for receiving the barrel 30 when the second hand guard portion 50 is coupled to the first receiver 26 and the front sight 32. The bore 52 will be referred to as a first bore 52 throughout this description. As known in the art, the first and second hand guard portions 48, 50 are removable from the first weapon 22. The second hand guard portion 50 is removable from the first weapon 22 for allowing the second weapon 24 to be mounted to the first weapon 22 without redesigning the first weapon 22 as discussed in detail below. The first hand guard portion 48 is commonly referred to as a top hand guard and the second hand guard portion 50 is commonly referred to as a bottom hand guard.

The second weapon 24 is selectively mounted to the first weapon 22 with the second weapon 24 being movable between an engaged position attached to the first weapon 22 as shown in FIG. 1, and a disengaged position detached from the first weapon 22 as shown in FIG. 2. The second weapon 24 can be fired while being mounted to the first weapon 22 or can be fired when detached from the first weapon 22. When the second weapon 24 is detached from the first weapon 22, i.e. in the disengaged position as shown in FIG. 2, each of the first and second weapons 22, 24 are commonly referred to as a stand-alone weapon. When the first weapon 22 is being used as the stand-alone weapon, the second hand guard portion 50 is coupled to the first receiver 26 and the front sight 32 thus the first and second hand guard portions 48, 50 encircle the barrel 30.

The second weapon 24 includes a receiver 54, which will be referred to as a second receiver 54 throughout this description. The second receiver 54 houses several of the working components of the second weapon 24, such as the firing components, i.e. the action. The second receiver 54 includes a forward end 56 and a rear end 58 spaced from each other. The second receiver 54 defines a bore 60 along a longitudinal axis L and disposed through the forward and rear ends 56, 58. The bore 60 will be referred to as a second bore 60 throughout this description.

Figure 4:
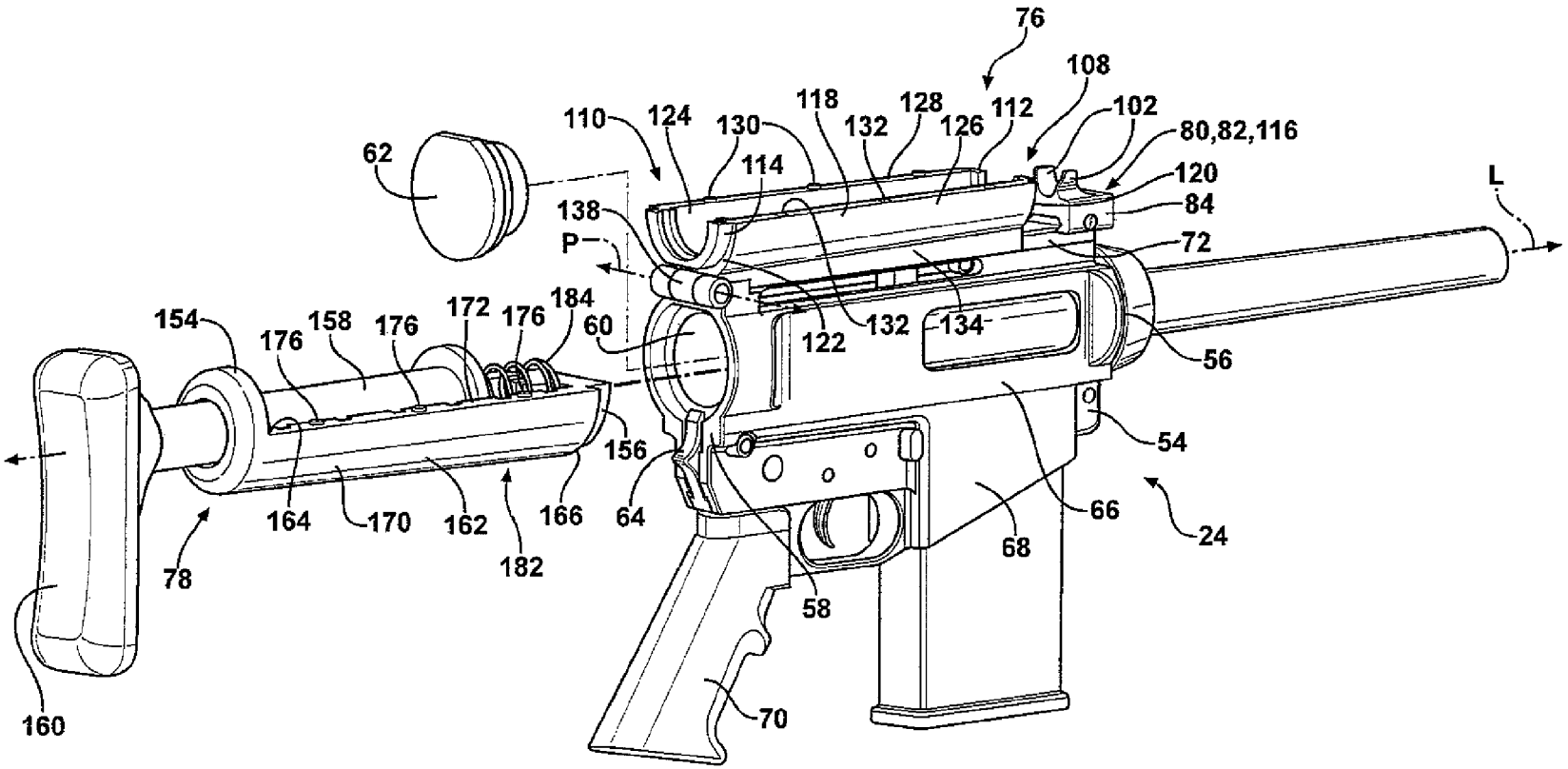
FIG. 4 is a perspective view of the second weapon in a disengaged position with the second portion in the first position and illustrating a buttstock and a cap exploded from the second weapon.

Referring to FIGS. 1 and 4, a cap 62 is disposed over the second bore 60 when the second weapon 24 is in the engaged position for preventing debris from entering the second bore 60. The cap 62 is removable from the second bore 60 when the second weapon 24 is in the disengaged position for allowing the second weapon 24 to function as the stand-alone weapon, which will be discussed further below. The cap 62 fits snuggly into the second bore 60 for preventing debris from entering the second bore 60 and for aiding in maintaining the cap 62 within the second bore 60.

Figure 5A:
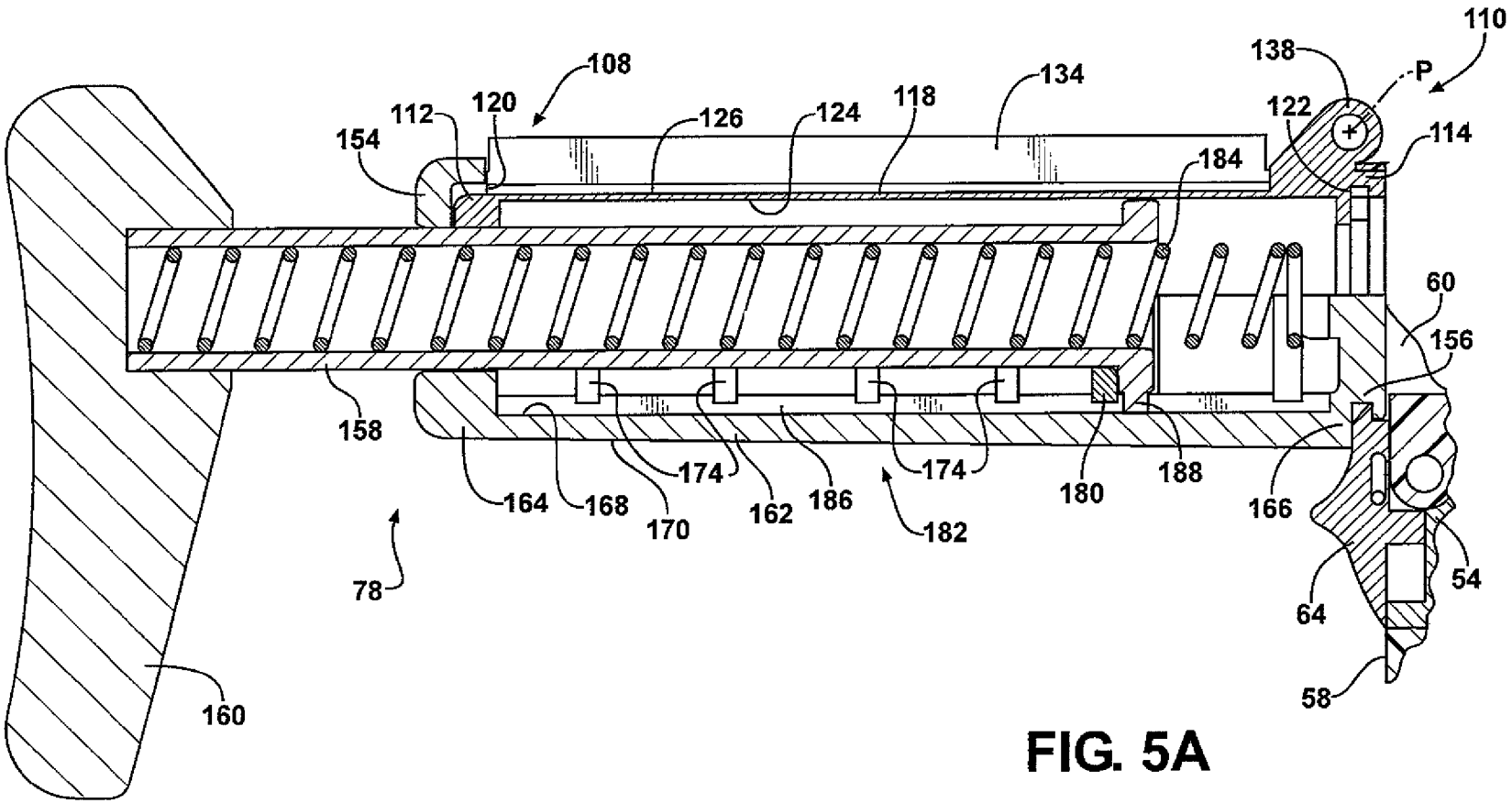
FIG. 5A is a broken cross-sectional view of the second portion in the second position with the buttstock of the second weapon coupled to the second portion and the locking member engaging the buttstock in the initial position.
Figure 5B:
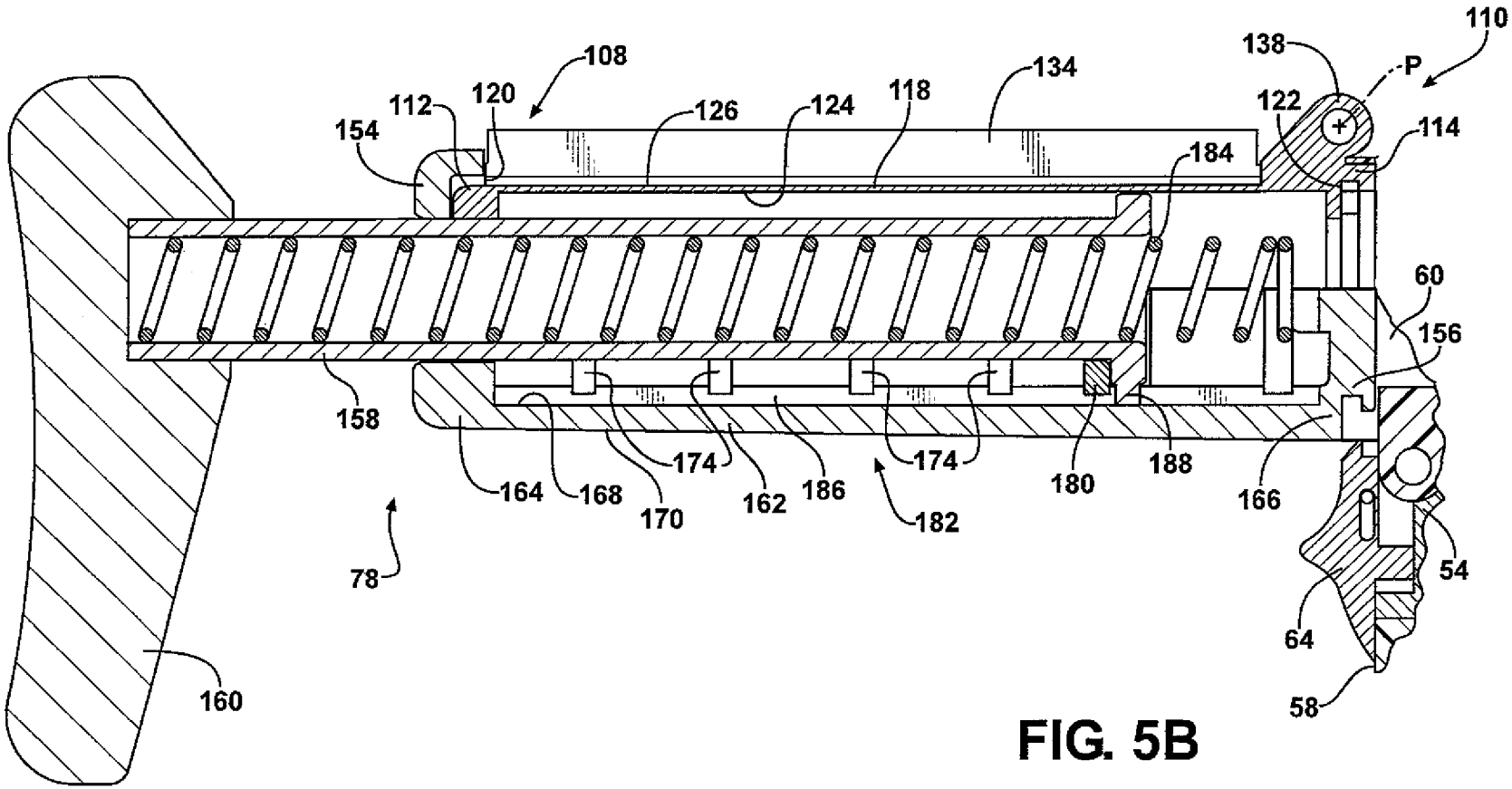
FIG. 5B is a broken cross-sectional view of the second portion in the second position with the locking member disengaged from the buttstock in the displaced position.

A locking member 64 is coupled to the second receiver 54 adjacent the second bore 60 with the locking member 64 movable between an initial position as shown in FIGS. 1, 2, 3A, 3B, 4, 5A and 6, and a displaced position as shown in FIGS. 3B and 5B. Turning to FIGS. 3A and 3B, the locking member 64 engages the cap 62 when disposed over the second bore 60 for aiding in maintaining the cap 62 within the second bore 60 when the second weapon 24 is in the engaged position. In other words, the locking member 64 engages the cap 62 when in the initial position for aiding in maintaining the cap 62 within the second bore 60 and the locking member 64 disengages from the cap 62 when in the displaced position for allowing removal of the cap 62 from the second bore 60. The locking member 64 is continuously spring biased into the initial position and will be discussed further below.

As known in the art, the second receiver 54 is often divided into an upper receiver portion 66 and a lower receiver portion 68 attached to each other, as shown in FIGS. 1, 2, 4 and 6. The lower receiver portion 68 of the second weapon 24 includes a hand grip 70 for supporting the second weapon 24 during firing. In other words, the hand grip 70 of the second weapon 24 is functional while the second weapon 24 is mounted to the first weapon 22 or while the second weapon 24 is being used as the stand-alone weapon, thus eliminating stress to a magazine while firing, as discussed in the background of the invention.

Figure 6:
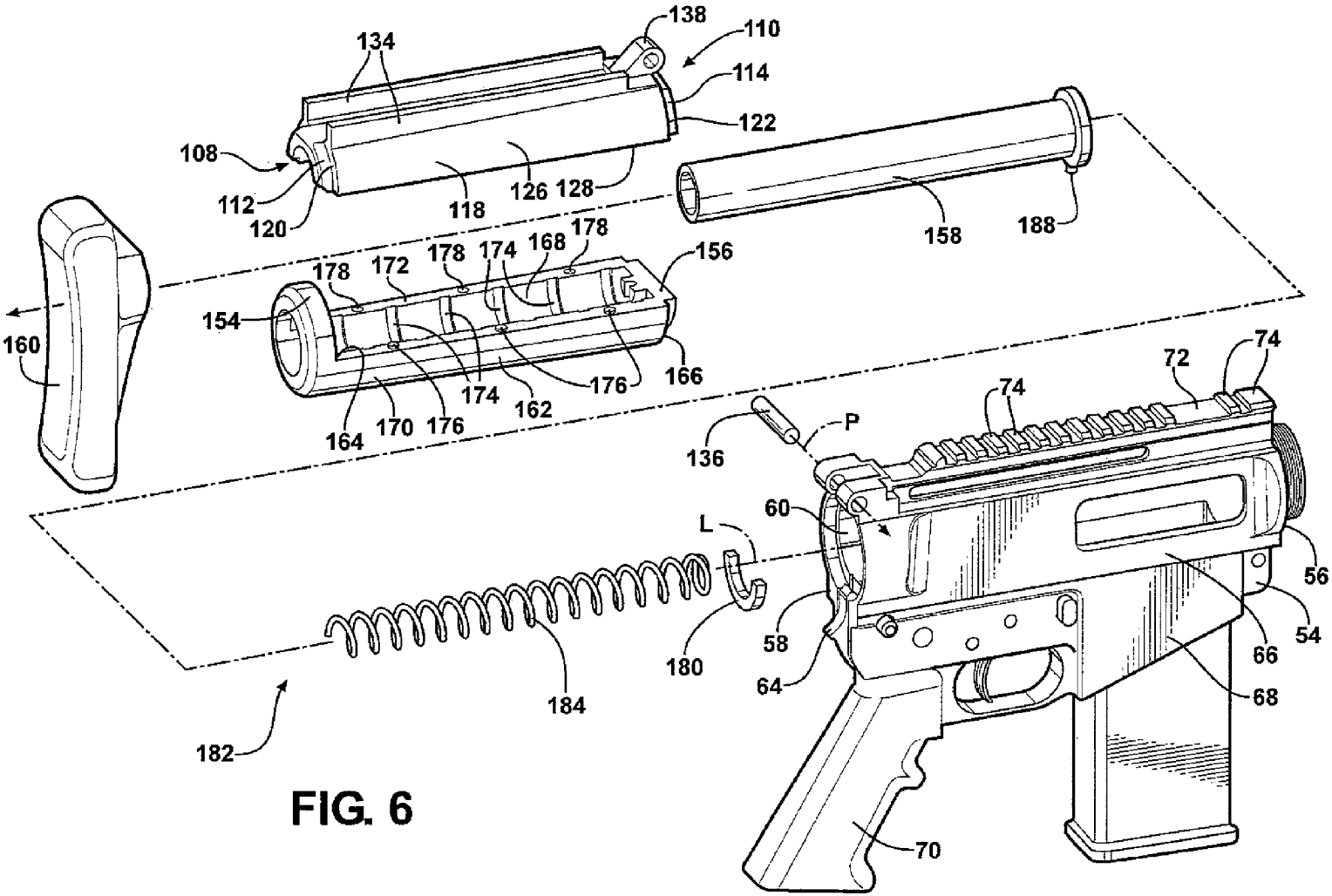
FIG. 6 is a partial exploded perspective view of the second weapon with the locking device removed.

As best shown in FIGS. 2 and 6, the second receiver 54 includes at least one rail 72 having a plurality of lugs 74 spaced from each other relative to the longitudinal axis L. More specifically, the upper receiver portion 66 of the second weapon 24 includes the rail 72, the lugs 74 and the second bore 60. Referring to FIG. 4, the second weapon 24 further includes a mounting system 76 and a buttstock 78 each coupled to the second receiver 54. More specifically, the mounting system 76 is coupled to the upper receiver portion 66 of the second weapon 24 and the buttstock 78 is selectively coupled to the upper receiver portion 66 of the second weapon 24. Details of the buttstock 78 and the rail 72 will be discussed further below.

The mounting system 76 allows for easy retro-fitting of the second weapon 24 to a variety of currently and/or previously manufactured first weapon 22 designs. In other words, the first weapon 22 requires no redesign. The mounting system 76 also eliminates the need for individual small components, as discussed in the background of the invention, to assemble the second weapon 24 as the stand-alone weapon, which will be discussed in detail below.

Also referring to FIGS. 3A and 3B, the mounting system 76 includes a first attachment segment 80 attached to the second receiver 54 and coupled to the front sight 32 when the second weapon 24 is in the engaged position. More specifically, the mounting system 76 includes a locking device 82 attached to the second receiver 54 and defines the first attachment segment 80. The locking device 82 engaging the front sight 32 when the second weapon 24 is in the engaged position.

Figure 7:
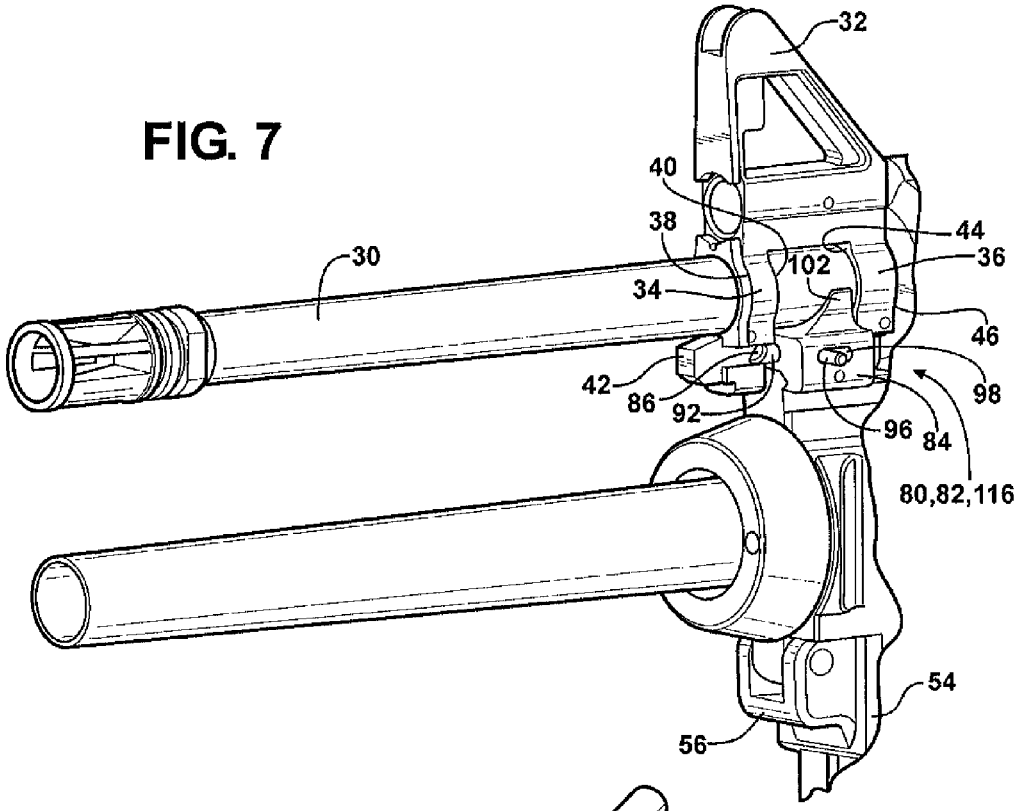
FIG. 7 is a broken perspective view of the locking device engaging a front sight of the first weapon.
Figure 8:
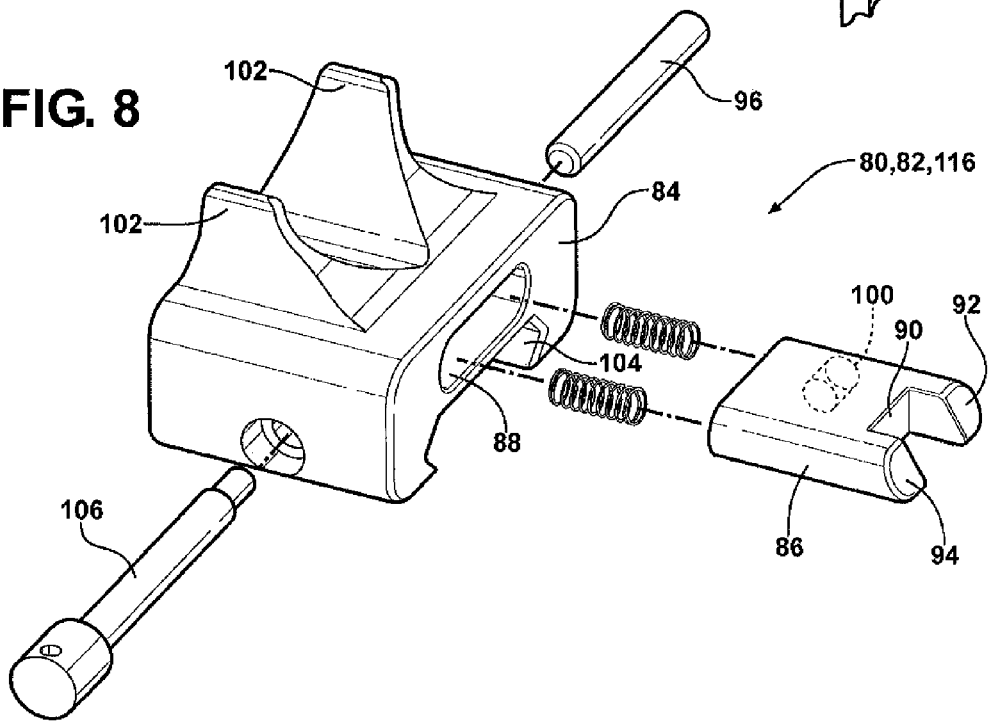
FIG. 8 is an exploded perspective view of the locking device.
Figure 9:
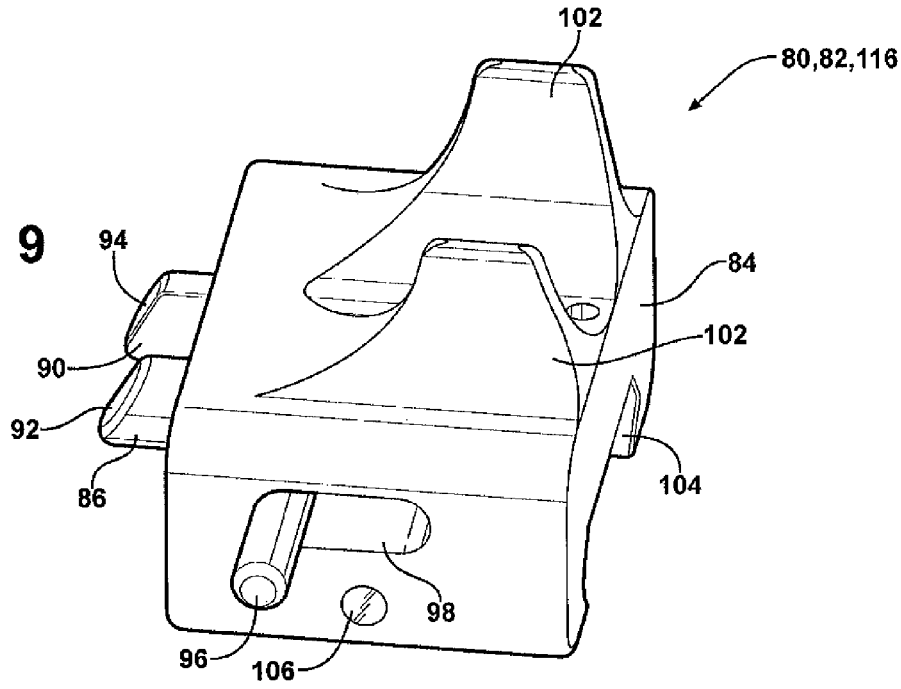
FIG. 9 is a perspective view of the locking device.

As best shown in FIGS. 1, 3A and 7, the locking device 82 engages one of the first and second legs 34, 36 of the front sight 32 when the second weapon 24 is in the engaged position. The locking device 82 includes a body portion 84 disposed between the first and second legs 34, 36 and a latch 86 extending outwardly from the body portion 84. More specifically, the body portion 84 defines a hollow 88 for receiving the latch 86 as shown in FIG. 8. The latch 86 is movable between a locked position engaging one of the first and second legs 34, 36 as shown in FIG. 7, and an unlocked position disengaged from one of the first and second legs 34, 36 as shown in FIG. 3B. More specifically, the latch 86 selectively engages one of the first back side 40 of the first leg 34 and the second front side 44 of the second leg 36. Even more specifically, the latch 86 selectively engages the first back side 40 of the first leg 34. Most specifically, the latch 86 defines an indentation 90 extending a predetermined distance to define a first finger 92 and a second finger 94 spaced from each other as shown in FIGS. 8 and 9, with the first back side 40 of the first leg 34 disposed between the first and second fingers 92, 94 within the indentation 90 as shown in FIG. 3A. The latch 86 is continuously spring biased outwardly from the hollow 88. In other words, the latch 86 is continuously spring biased into the locked position.

As best shown in FIGS. 7-9, the locking device 82 further includes a lever 96 engaging the latch 86 to move the latch 86 between the locked and unlocked positions. More specifically, the body portion 84 defines a slit 98 intersecting the hollow 88 and the latch 86 defines an aperture 100 aligning with the slit 98 such that the lever 96 is disposed through the slit 98 and into the aperture 100 for allowing the latch 86 to move between the locked and unlocked positions.

Figure 10:
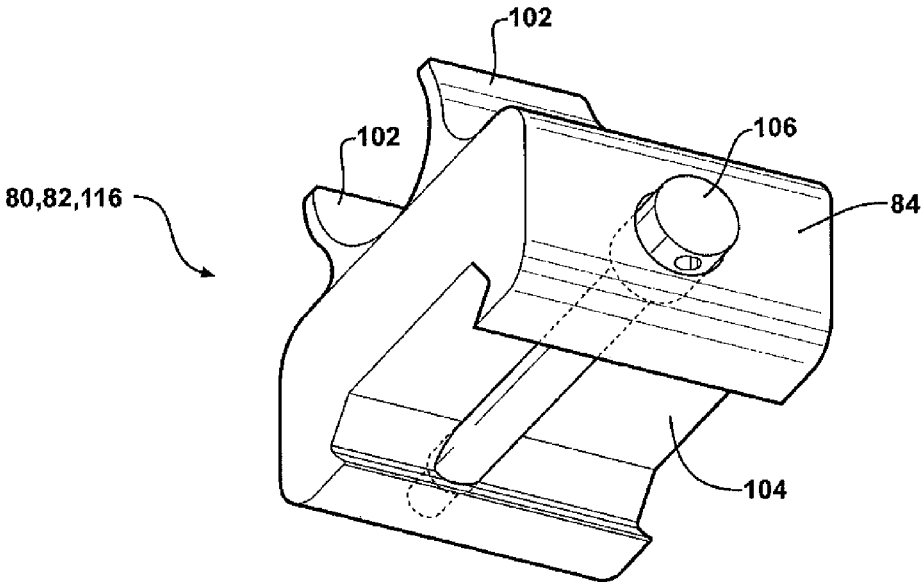
FIG. 10 is a bottom perspective view of the locking device.

Also referring to FIG. 10, the body portion 84 also includes a pair of arms 102 spaced from each other with the barrel 30 of the first weapon 22 disposed between the arms 102 when the second weapon 24 is in the engaged position. The body portion 84 further defines a channel 104 spaced from the hollow 88 for receiving the rail 72 and the lugs 74 of the second receiver 54. More specifically, the channel 104 is configured complementary to the configurations of the rail 72 and the lugs 74 such that the body portion 84 slides onto the rail 72 and is only movable back and forth along the rail 72.

The locking device 82 also includes a locking pin 106 disposed through the body portion 84 for attaching the locking device 82 to the rail 72. More specifically, the locking pin 106 is disposed through the body portion 84 and the channel 104 such that the locking pin 106 is disposed between a pair of lugs 74 of the rail 72 for preventing the locking device 82 from moving back and forth along the rail 72. In other words, disposing the locking pin 106 between the lugs 74 prevents the locking device 82 from moving back and forth along the rail 72 and thus attaches or secures the locking device 82 to the rail 72 in a specific location. The locking pin 106 is inserted through the body portion 84 and is exposed in the channel 104 of the body portion 84 thus allowing the locking pin 106 to engage at least one of the pair of lugs 74 for attaching the locking device 82 to the second receiver 54. Alternatively, the locking pin 106 can engage both of the pair of lugs 74 for attaching the locking device 82 to the second receiver 54. In yet another alternative, the locking pin 106 engages the body portion 84 and the rail 72 for attaching the locking device 82 to the second receiver 54. The locking pin 106 is selectively removable from the body portion 84 thus allowing easy replacement of the locking device 82.

Referring back to FIGS. 3A, 3B and 4, the mounting system 76 further includes a second attachment segment 108 coupled to the second receiver 54 and spaced from the first attachment segment 80. The second attachment segment 108 is coupled to the front sight 32 when the second weapon 24 is in the engaged position. The mounting system 76 additionally includes a third attachment segment 110 coupled to the second receiver 54 and spaced from the first and second attachment segments 80, 108. The third attachment segment 110 is coupled to the first receiver 26 when the second weapon 24 is in the engaged position. More specifically, the mounting system 76 includes a first flange 112 defining the second attachment segment 108 and a second flange 114 defining the third attachment segment 110 with the first and second flanges 112, 114 coupled to the second receiver 54. The second attachment segment 108 and the third attachment segment 110 are integrally formed of a metal material. More specifically, the metal material of the second and third attachment segments 108, 110 are typically an alloy. Suitable alloys include aluminum and/or iron alloys, e.g. steel. It is to be appreciated that other metal materials can also be used for the second and third attachment segments 108, 110.

The mounting system 76 includes a first portion 116 attached to the second receiver 54 and a second portion 118 coupled to the second receiver 54 and spaced from the first portion 116. The first portion 116 is coupled to the front sight 32 to define a first attachment point when the second weapon 24 is in the engaged position. The first portion 116 is defined as the first attachment segment 80 and the second portion 118 is defined as the second and third attachment segments 108, 110. More specifically, the locking device 82 defines the first portion 116 with the locking device 82 engaging the front sight 32 when the second weapon 24 is in the engaged position.

A portion 118 of the mounting system 76 is rotatable about a pivot axis P when the second weapon 24 is in the disengaged position. The portion 118 will be referred to as the second portion 118 throughout this description. The second portion 118 is rotatable between a first position presenting a plurality of attachment segments 108, 110 to the first weapon 22 for allowing the second weapon 24 to be mounted to the first weapon 22 and a second position presenting at least one of the attachment segments 108, 110 to the buttstock 78 for allowing the buttstock 78 to be mounted to the second portion 118. The first position is best shown in FIGS. 1, 3A, 3B and 4, and the second position is best shown in FIGS. 2, 5A and 5B. The second portion 118 is integrally formed of a metal material. More specifically, the metal material of the second portion 118 is typically an alloy. Suitable alloys include aluminum and/or iron alloys, e.g. steel. It is to be appreciated that other metal materials can also be used for the second portion 118.

Turning to FIGS. 1, 3A and 3B, the second portion 118 includes a first end 120 coupled to the front sight 32 to define a second attachment point and a second end 122 coupled to the first receiver 26 to define a third attachment point when the second weapon 24 is in the engaged position. The second portion 118 includes the first flange 112 extending from the first end 120 to define the second attachment point. The second portion 118 also includes the second flange 114 extending from the second end 122 spaced from the first flange 112 to define the third attachment point.

Figure 11:
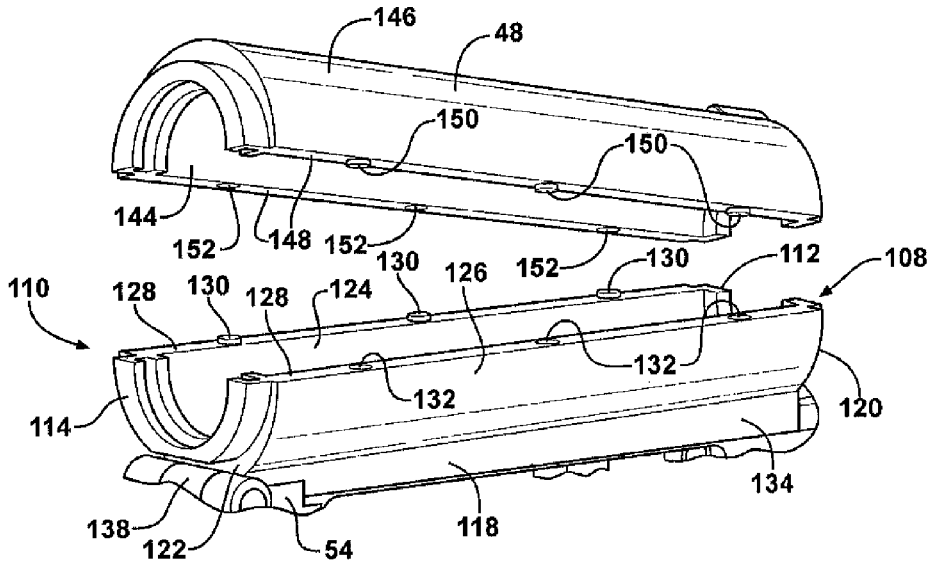
FIG. 11 is a broken exploded perspective view of the second portion having a plurality of first protrusions and a plurality of first recesses with a hand guard portion of the first weapon having a plurality of second protrusions and a plurality of second recesses aligning with the first recesses and the first protrusions, respectively.

As best shown in FIG. 11, the second portion 118 includes an inner surface 124, an outer surface 126 and a first edge 128 disposed between the inner and outer surfaces 124, 126. The first edge 128 includes at least one of a plurality of first protrusions 130 and a plurality of first recesses 132 spaced from each other. Also referring to FIGS. 4 and 6, the outer surface 126 includes a pair of strips 134 spaced from each other with the strips 134 engaging the second receiver 54 when in the first position. The rail 72 is disposed between the strips 134 such that the outer surface 126 of the second portion 118 engages the second receiver 54 when in the first position. The first protrusions 130 and the first recesses 132 will be discussed further below.

The mounting system 76 also includes a pin 136 disposed along the pivot axis P through the second portion 118 and the receiver for allowing rotation of the second portion 118 between the first and second positions. More specifically, the pin 136 is disposed through the second end 122 of the second portion 118. Even more specifically, the second portion 118 includes a projection 138 extending from the second end 122 with the pin 136 disposed through the projection 138 for allowing rotation of the second portion 118 between the first and second positions. Most specifically, the outer surface 126 of the second portion 118 includes the projection 138 disposed between the strips 134 and coupled to the second receiver 54 for allowing rotation of the second portion 118 between the first and second positions. In other words, the pin 136 is disposed through the projection 138 for allowing rotation about the pivot axis P. Having the second portion 118 rotatably coupled to the second receiver 54 and functioning as part of the mounting system 76 and part of the buttstock 78 eliminates the need for multiple individual attachments to convert the second weapon 24 to the stand-alone weapon.

Referring to FIGS. 1, 3A and 3B, the firearm assembly 20 further includes a first support 140 and a second support 142 spaced from the first support 140. The first support 140 is attached to the front sight 32 with the first flange 112 engaging the first support 140 when the second weapon 24 is in the engaged position. More specifically, the first support 140 is further defined as a first collar attached or fixed to the second leg 36 of the front sight 32 and facing away from the first leg 34. Even more specifically, the first support 140 is attached to the second back side 46 of the second leg 36 and encircles the barrel 30 for receiving the first flange 112.

The second support 142 is coupled to the front end 28 of the first receiver 26 and is movable between a rest position engaging the second flange 114 as shown in FIGS. 1 and 3A, and a release position disengaged from the second flange 114 as shown in FIG. 3B. The second support 142 is continuously spring biased into the rest position. The second support 142 is further defined as a second collar encircling the barrel 30 and coupled to the front end 28 of the first receiver 26 such that the second support 142 is movable between the rest and release positions. When the first and second flanges 112, 114 engage the first and second supports 140, 142 respectively, with the first portion 116 or the locking device 82 secured to the front sight 32, the second weapon 24 is mounted to the first weapon 22, i.e. in the engaged position. When the first portion 116 or the locking device 82 is secured to the front sight 32, the second weapon 24 is prevented from rotating about the pivot axis P.

As discussed above, the first weapon 22 includes the first hand guard portion 48 coupled to the first receiver 26 and the front sight 32. More specifically, the first and second hand guard portions 48, 50 engage the first and second supports 140, 142 when the first weapon 22 is being used as the stand-alone weapon. When the second weapon 24 is mounted to the first weapon 22, i.e. in the engaged position, the first hand guard portion 48 and the second portion 118 engage each other to define the first bore 52 therebetween for receiving the barrel 30. In other words, the first bore 52 can be defined either when the first and second hand guard portions 48, 50 engage each other or when the first hand guard portion 48 and the second portion 118 engage each other.

Referring to FIG. 11, the first hand guard portion 48 includes an internal surface 144, an external surface 146 and a second edge 148 disposed between the internal and external surfaces 144, 146 with the first edge 128 engaging the second edge 148 when the second weapon 24 is in the engaged position. The second edge 148 includes at least one of a plurality of second protrusions 150 and a plurality of second recesses 152 spaced from each other. More specifically, the first edge 128 of the second portion 118 includes the first protrusions 130 and the first recesses 132 with the second edge 148 including the second protrusions 150 receiving the first recesses 132 and the second recesses 152 receiving the first protrusions 130 when the second weapon 24 is in the engaged position to create a friction fit. Even more specifically, as shown in FIG. 11, one side of the first edge 128 includes the first protrusions 130 and another side of the first edge 128 includes the first recesses 132 with one side of the second edge 148 having the second recesses 152 corresponding to the first protrusions 130 and another side of the second edge 148 having second protrusions 150 corresponding to the first recesses 132. In one embodiment, the first edge 128 includes only the first protrusions 130 and the second edge 148 includes only the second recesses 152 corresponding to the first protrusions 130. In another embodiment, the first edge 128 includes only the first recesses 132 and the second edge 148 includes only the second protrusions 150 corresponding to the first recesses 132. In yet another embodiment, the first protrusions 130 and the first recesses 132 can alternate with the second protrusions 150 and the second recesses 152 alternating respectively. Even though not illustrated, the second hand guard portion 50 of the first weapon 22 includes corresponding protrusions (not shown) and recesses (not shown) for receiving the second protrusions 150 and the second recesses 152 of the first hand guard portion 48 when the first weapon 22 is being used as the stand-alone weapon.

As mentioned above, the buttstock 78 is coupled to the second receiver 54 when the second weapon 24 is in the disengaged position. In other words, the buttstock 78 is detachable from the second weapon 24 as best shown in FIGS. 1 and 4. The buttstock 78 is carried in a user's pack until a user detaches the second weapon 24 from the first weapon 22 to convert the second weapon 24 to the stand-alone weapon. Having the hand grip 70 of the second weapon 24 attached to the second receiver 54 while the second weapon 24 is in either of the engaged and disengaged positions reduces the size of the buttstock 78 carried in the user's pack.

The buttstock 78 is one unit which is easily mounted to the second portion 118 when using the second weapon 24 as the stand-alone weapon. When the user wants to use the second weapon 24 as the stand-alone weapon, the buttstock 78 is mounted to the second portion 118, as further described below, with the second portion 118 rotated to the second position such that the buttstock 78 and the second portion 118 engage the second bore 60 of the second receiver 54. When the user wants to mount the second weapon 24 to the first weapon 22, the buttstock 78 and second portion 118 are disengaged from the second bore 60 of the second receiver 54 with the buttstock 78 uncoupled from the second portion 118 and the second portion 118 rotated to the first position such that the second weapon 24 is ready to be mounted to the first weapon 22. No particular order of assembling or disassembling the buttstock 78 from the second weapon 24 is required.

Turning to FIGS. 4, 5A, 5B and 6, the buttstock 78 includes a support 154 for receiving the first flange 112 to couple the buttstock 78 to the second portion 118. The support 154 will be referred to as a third support 154 throughout this description. The buttstock 78 includes a third flange 156 spaced from the third support 154 with the second and third flanges 114, 156 disposed in the second bore 60 of the second receiver 54 when the second portion 118 is in the second position. More specifically, the buttstock 78 includes a base 158 and a stock 160 attached to the base 158 with the third support 154 coupled to the base 158. The second portion 118 supports the base 158 and the stock 160 when the second portion 118 is in the second position. The stock 160 abuts a user's shoulder during firing of the second weapon 24.

As mentioned above, the cap 62 is disposed over the second bore 60 when the second weapon 24 is in the engaged position for preventing debris from entering the second bore 60. The cap 62 is removed from the second bore 60 when the second weapon 24 is in the disengaged position for receiving the second and third flanges 114, 156. Even though the cap 62 and the buttstock 78 are independently used with the second weapon 24, for illustrative purposes only, the cap 62 and the buttstock 78 are both shown in FIG. 4.

The buttstock 78 includes a cover 162 coupled to the base 158 and partially encircling the base 158 with the cover 162 having a proximal end 164 and a distal end 166 spaced from the proximal end 164. More specifically, the cover 162 includes the third support 154 extending from the proximal end 164 and encircling the base 158 for receiving the second portion 118 when the second weapon 24 is in the disengaged position. The third support 154 can be further defined as a collar or any other suitable support.

The cover 162 includes the third flange 156 extending from the distal end 166 with the second bore 60 of the second receiver 54 receiving the third flange 156 when the second portion 118 is in the second position. As discussed above, the locking member 64 is coupled to the second receiver 54 adjacent the second bore 60 and movable between the initial position and the displaced position. When the locking member 64 is in the initial position, the locking member 64 engages the third flange 156 when the second portion 118 is in the second position for preventing undesirable rotation of the second portion 118 about the pivot axis P. When the locking member 64 is in the displaced position, the locking member 64 disengages from the third flange 156 for allowing rotation of the second portion 118. The locking member 64 is continuously spring biased into the initial position, thus the locking member 64 moves to the displaced position when rotating the second portion 118 to the second position to initially engage the third flange 156 and the locking member 64 moves to the displaced position when rotating the second portion 118 to the first position. The locking member 64 can be further defined as a tab or any other suitable locking member 64 selectively aiding in maintaining the position of the cap 62 and/or the third flange 156.

Figure 12:
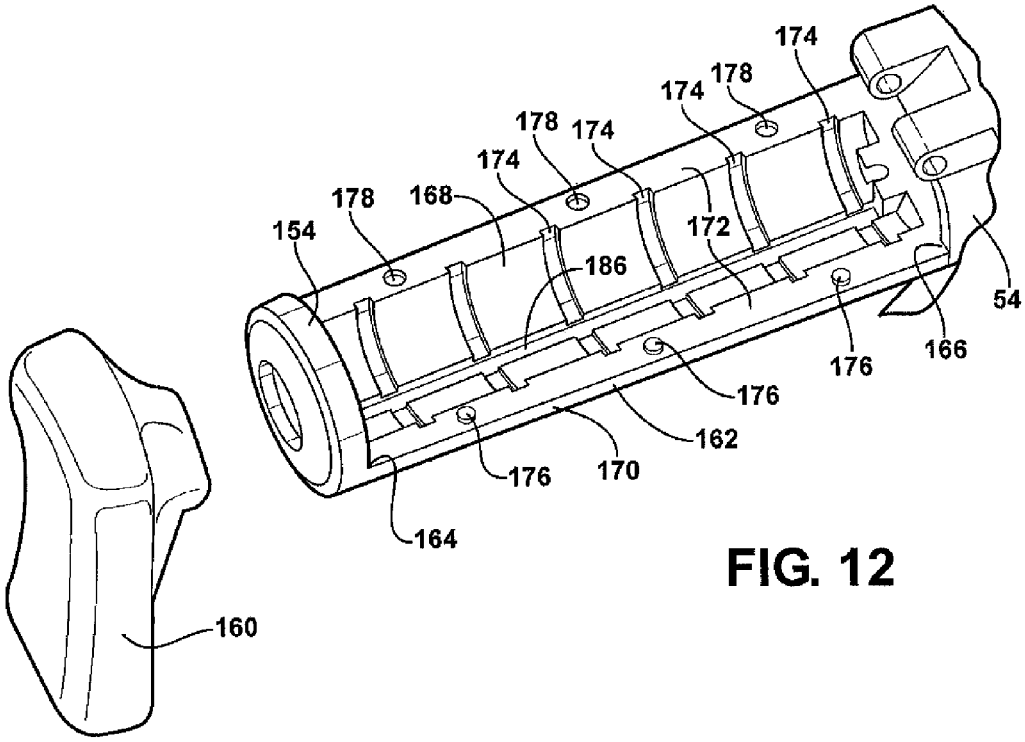
FIG. 12 is a broken partial exploded perspective view of the buttstock coupled to a second receiver with the second portion and a base of the buttstock removed.

As best shown in FIGS. 6 and 12, the cover 162 includes an interior surface 168, an exterior surface 170 and an outer edge 172 disposed between the interior and exterior surfaces 168, 170. The interior surface 168 of the cover 162 defines a plurality of grooves 174 disposed between the proximal and distal ends 164, 166. The outer edge 172 includes at least one of a plurality of outer protrusions 176 and a plurality of edge recesses 178 spaced from each other. More specifically, the first edge 128 of the second portion 118 includes the first protrusions 130 and the first recesses 132 with the outer edge 172 including the outer protrusions 176 receiving the first recesses 132 and the edge recesses 178 receiving the first protrusions 130 when the buttstock 78 is mounted to the second portion 118 to create a friction fit. Even more specifically, as shown in FIG. 12, one side of the first edge 128 includes the first protrusions 130 and another side of the first edge 128 includes the first recesses 132 with one side of the outer edge 172 having the edge recesses 178 corresponding to the first protrusions 130 and another side of the outer edge 172 having outer protrusions 176 corresponding to the first recesses 132. In other words, the cover 162 and the second portion 118 encircle the base 158 when the cover 162 and the second portion 118 engage each other as best shown in FIGS. 2, 5A and 5B. In one embodiment, the first edge 128 includes only the first protrusions 130 and the outer edge 172 includes only the edge recesses 178 corresponding to the first protrusions 130. In another embodiment, the first edge 128 includes only the first recesses 132 and the outer edge 172 includes only the outer protrusions 176 corresponding to the first recesses 132. In yet another embodiment, the first protrusions 130 and the first recesses 132 can alternate with the outer protrusions 176 and the edge recesses 178 alternating respectively.

Referring to FIGS. 5A, 5B and 6, an adjustment member 180 is disposed in one of the grooves 174 and engages the base 158 for adjusting a length of the buttstock 78. More specifically, the adjustment member 180 allows for changing the length of the buttstock 78 to adjust an amount of recoil after firing the second weapon 24. Thus, the buttstock 78 can include a buffer system 182 as known in the art for absorbing recoil after the second weapon 24 is fired. Even more specifically, the adjustment member 180 allows the base 158 to be adjusted relative to the cover 162 and the second portion 118. The buffer system 182 can include a coil spring 184 at least partially disposed in the base 158 and can include the adjustment member 180. It is to be appreciated that the buffer system 182 is optional.

Also referring to FIG. 12, the interior surface 168 of the cover 162 defines a slot 186 intersecting the grooves 174 for receiving a piece of the base 158. The base 158 includes an extension 188 defining the piece with the extension 188 disposed in the slot 186 for guiding the base 158 during movement between the proximal and distal ends 164, 166 and for preventing rotation of the base 158. More specifically, the base 158 engages the inner surface 124 of the second portion 118 and the extension 188 engages the interior surface 168 of the cover 162 when the buttstock 78 is mounted to the second portion 118 while the cover 162 and the second portion 118 encircle the base 158.

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A firearm assembly comprising:

a first weapon including a first receiver having a front end, a barrel attached to said front end with said barrel defining a barrel axis, and a front sight attached to said barrel;

a second weapon selectively mounted to said first weapon and including a second receiver and a mounting system coupled to said second receiver with said second weapon being movable between an engaged position attached to said first weapon and a disengaged position detached from said first weapon;

said mounting system including:

a first portion attached to said second receiver and coupled to said front sight to define a first attachment point when said second weapon is in said engaged position, and a second portion coupled to said second receiver and spaced from said first portion in a direction along said barrel axis, with said second portion having a first end coupled to said front sight to define a second attachment point and a second end coupled to said first receiver to define a third attachment point when said second weapon is in said engaged position;

wherein said first weapon includes a hand guard portion coupled to said first receiver and said front sight with said hand guard portion and said second portion engaging each other when said second weapon is in said engaged position to define a bore therebetween for receiving said barrel.

2. A firearm assembly as set forth in claim 1 wherein said second portion includes a first flange extending from said first end to define said second attachment point and a second flange extending from said second end to define said third attachment point.

3. A firearm assembly as set forth in claim 2 further including a first support attached to said front sight with said first flange engaging said first support when said second weapon is in said engaged position.

4. A firearm assembly as set forth in claim 3 further including a second support coupled to said front end of said first receiver and spaced from said first support with said second support movable between a rest position engaging said second flange and a release position disengaged from said second flange.

5. A firearm assembly as set forth in claim 1 wherein said second portion includes an inner surface, an outer surface and a first edge disposed between said inner and outer surfaces with said first edge having at least one of a plurality of first protrusions and a plurality of first recesses spaced from each other.

6. A firearm assembly as set forth in claim 5 wherein said hand guard portion including an internal surface, an external surface and a second edge disposed between said internal and external surfaces with said first edge engaging said second edge when said second weapon is in said engaged position.

7. A firearm assembly as set forth in claim 6 wherein said second edge includes at least one of a plurality of second protrusions and a plurality of second recesses spaced from each other.

8. A firearm assembly as set forth in claim 7 wherein said first edge includes said first protrusions and said first recesses with said second edge including said second protrusions receiving said first recesses and said second recesses receiving said first protrusions when said second weapon is in said engaged position.

9. A firearm assembly as set forth in claim 1 wherein said mounting system includes a locking device attached to said second receiver and defining said first portion with said locking device engaging said front sight when said second weapon is in said engaged position.

10. A firearm assembly as set forth in claim 9 wherein said front sight includes a first leg and a second leg spaced from each other with said locking device engaging one of said first and second legs when said second weapon is in said engaged position.

11. A firearm assembly as set forth in claim 10 wherein said locking device includes a body portion disposed between said first and second legs and a latch extending outwardly from said body portion with said latch movable between a locked position engaging one of said first and second legs and an unlocked position disengaged from one of said first and second legs.

12. A firearm assembly as set forth in claim 11 wherein said body portion includes a pair of arms spaced from each other with said barrel disposed between said arms when said second weapon is in said engaged position.

13. A firearm assembly comprising:

a first weapon;

a second weapon selectively mounted to said first weapon with said second weapon being movable between an engaged position attached to said first weapon and a disengaged position detached from said first weapon;

said second weapon including:

a receiver, a buttstock, a mounting system coupled to said receiver, and a portion of said mounting system being rotatable about a pivot axis when said second weapon is in said disengaged position with said portion rotatable between a first position presenting a plurality of attachment segments to said first weapon for allowing said second weapon to be mounted to said first weapon and a second position presenting at least one of said attachment segments to said buttstock for allowing said buttstock to be mounted to said portion.

14. A firearm assembly as set forth in claim 13 wherein said mounting system includes a pin disposed along said pivot axis through said portion and said receiver for allowing rotation of said portion between said first and second positions.

15. A firearm assembly as set forth in claim 14 wherein said portion includes a first end having a first flange and a second end having a second flange spaced from said first flange with said pin disposed through said second end.

16. A firearm assembly as set forth in claim 15 wherein said portion includes a projection extending from said second end with said pin disposed through said projection for allowing rotation of said portion between said first and second positions.

17. A firearm assembly as set forth in claim 15 wherein said buttstock includes a support for receiving said first flange to couple said buttstock to said portion.

18. A firearm assembly as set forth in claim 17 wherein said buttstock includes a third flange spaced from said support with said receiver defining a bore along a longitudinal axis such that said second and third flanges are disposed in said bore when said portion is in said second position.

19. A firearm assembly as set forth in claim 18 further including a cap disposed over said bore when said second weapon is in said engaged position for preventing debris from entering said bore with said cap removed from said bore when said second weapon is in said disengaged position for receiving said second and third flanges.

20. A firearm assembly as set forth in claim 13 wherein said buttstock includes a base and a stock attached to said base with said portion supporting said base and said stock when said portion is in said second position.

21. A firearm assembly as set forth in claim 20 wherein said buttstock includes a cover coupled to said base and partially encircling said base with said cover having a proximal end and a distal end spaced from said proximal end.

22. A firearm assembly as set forth in claim 21 wherein said cover includes a support extending from said proximal end and encircling said base for receiving said portion when said second weapon is in said disengaged position.

23. A firearm assembly as set forth in claim 21 wherein said portion includes an inner surface, an outer surface and a first edge disposed between said inner and outer surfaces with said first edge having at least one of a plurality of first protrusions and a plurality of first recesses spaced from each other.

24. A firearm assembly as set forth in claim 23 wherein said cover includes an interior surface, an exterior surface and an outer edge disposed between said interior and exterior surfaces with said outer edge having at least one of a plurality of outer protrusions and a plurality of edge recesses spaced from each other.

25. A firearm assembly as set forth in claim 24 wherein said first edge includes said first protrusions and said first recesses with said outer edge including said outer protrusions receiving said first recesses and said edge recesses receiving said first protrusions when said buttstock is mounted to said portion.

26. A firearm assembly as set forth in claim 24 wherein said interior surface of said cover defines a plurality of grooves disposed between said proximal and distal ends.

27. A firearm assembly as set forth in claim 26 further including an adjustment member disposed in one of said grooves and engaging said base for adjusting a length of said buttstock.

28. A firearm assembly as set forth in claim 26 wherein said interior surface of said cover defines a slot intersecting said grooves for receiving a piece of said base.

29. A firearm assembly as set forth in claim 28 wherein said base includes an extension defining said piece with said extension disposed in said slot for guiding said base during movement between said proximal and distal ends.

30. A firearm assembly as set forth in claim 21 wherein said cover includes a third flange extending from said distal end and said receiver defines a bore along a longitudinal axis for receiving said third flange when said portion is in said second position.

31. A firearm assembly as set forth in claim 30 further including a locking member coupled to said receiver adjacent said bore with said locking member movable between an initial position engaging said third flange when said portion is in said second position for preventing undesirable rotation of said portion and a displaced position disengaged from said third flange for allowing rotation of said portion.

32. A firearm assembly as set forth in claim 23 wherein said outer surface of said portion includes a pair of strips spaced from each other with said strips engaging said receiver when in said first position.

33. A firearm assembly as set forth in claim 32 wherein said outer surface of said portion includes a projection disposed between said strips and coupled to said receiver for allowing rotation of said portion between said first and second positions.

* * * * *